United States Patent [19]

Schumacher

[11] 3,967,873

[45] July 6, 1976

[54] WIRE TERMINAL ELECTRICAL CONTACT

[75] Inventor: Walter Carl Schumacher, Warwick, R.I.

[73] Assignee: General Electric Company, New York, N.Y.

[22] Filed: Feb. 27, 1975

[21] Appl. No.: 553,773

[52] U.S. Cl. ..... 339/95 D
[51] Int. Cl.[2] ..... H01R 9/08
[58] Field of Search ..... 339/95 R, 95 D, 98

[56] References Cited

UNITED STATES PATENTS

| | | | |
|---|---|---|---|
| 3,489,985 | 1/1970 | Martin | 339/95 D |
| 3,573,713 | 4/1971 | Enright | 339/98 |

*Primary Examiner*—Roy Lake
*Assistant Examiner*—Mark S. Bicks
*Attorney, Agent, or Firm*—Paul E. Rochford

[57] ABSTRACT

A wire terminal electrical contact is provided to accommodate wires of a wide range of diameters. The terminal is of the push-in type and includes a metal strip having spring properties within an insulating housing. Openings to the housing through which the wire is pushed to make contact accept the full range of wire diameters normally employed in household wiring ranging from No. 10 gauge to No. 14 gauge. Locking cams are formed from the spring metal strip by an F configuration of slits to form two side-by-side locking tongues. The free ends of the tongues are bent up from the strip to the housing interior and two adjoining openings are provided in the housing aligned with the vertical portion of the F. The openings are circular and accept the largest and smallest diameter wires. Also the openings intersect, but their area of intersection is smaller than the smallest diameter wire which will be used in either of the holes. A compact construction is achieved without danger of releasing a smaller diameter wire from the closely adjacent locking tongues.

1 Claim, 8 Drawing Figures

WIRE TERMINAL ELECTRICAL CONTACT

BACKGROUND

The extensive commerical use of push-in type connectors started with the development by Benander of the invention of the U.S. Pat. Nos. 2,705,785 and 2,705,787. Numerous push-in type connectors followed this commercial success. Other patents of later vintage concerned with the push-in type connector and having two side-by-side cam contacts on the same strip of metal include the U.S. Pat. Nos. 3,339,170 and 3,467,941 assigned to the same assignee as this application. Also U.S. Pat. No. 3,489,985 discloses a contiguous cam contact for a convenience outlet which is in its structure quite similar to that disclosed in the subject application.

Other relevant patents are the U.S. Pat. Nos. 2,974,301; 3,001,168; and 3,325,768 which were cited as references in the U.S. Pat. No. 3,489,985 assigned to the same assignee as this application.

One problem which has developed in the employment of the electrical contact of the device taught in the U.S. Pat. No. 3,489,985 is that very close dimensions of the contiguous cams must be maintained in order to prevent or avoid interference of one cam with the other. Such interference is particularly disadventageous where it causes reduction of the gripping power of an adjoining cam on a wire so that less than a full pressure contact, and suitably low resistance, is maintained between the inserted wire and the wire contact. One problem encountered in use of the receptacle of the U.S. Pat. No. 3,489,985 patent with its eight push-in connectors, is that it could be used only with the smaller size wires normally employed in branch circuits in residences. With the introduction of the copper clad aluminum wire the contact itself could function perfectly well with the copper clad wire but the wire diameter required is frequently a No. 10 size wire and this wire cannot be accommodated in the contact push-in connector structure of the U.S. Pat. No. 3,489,985.

Accordingly a problem arose in attempting to maintain the compactness of structure so that the receptacle with eight push-in connectors could be used in home construction, where it has its principal application, and yet accommodate the larger size wires which were an incident of the change to copper clad aluminum conductors in the home building trade.

An effort was made to eliminate this problem by enlarging the two openings seen in the U.S. Pat. No. 3,489,985 to a single overall opening of oval shape so that two No. 10 wires could fit into the opening and make the proper contact with the metal strip within the receptacle. While this permitted larger wire entry and contact was successfully established with the inserted wires, it was found that where a No. 10 copper clad wire was employed in combination with a No. 12 or No. 14 copper or copper clad wire in the same opening and the wires were manipulated as a consequence of the insertion of the receptacle into its wall box where it was to be employed, the contact on the smaller diameter wire was sometimes reduced so that a high resistance contact developed or that the contact with the smaller diameter wires was in fact broken due to the insertion of the wired receptacle into its wall box.

SUMMARY OF THE INVENTION

In one of its broader embodiments, the wire terminal electrical contact of this invention includes an insulating housing with at least one metal strip having spring properties positioned in the housing adjacent a wall of the housing having wire entry ports. The strip is provided with an F configuration of slits to form two contiguous metal tongues. The end portions of the tongues are bent up away from the adjacent wall of the insulation housing to form wire contact cams. Wire entry ports through the adjacent wall of the insulation housing are aligned with the cam ends to permit contact of the cam ends by wires entering the ports. The two ports are generally rounded and large enough to accept a No. 10 gauge wire. Also the two ports interlock but the width of the interlocking portion of the ports is smaller than the diameter of larger diameter wires introduced into the ports and in fact smaller than the smaller diameter wires introduced into the ports.

DESCRIPTION OF THE DRAWINGS

The description which follows will be made clearer by reference to the following drawing in which.

DESCRIPTION OF THE PREFERRED EMBODIMENT

Figure 1:
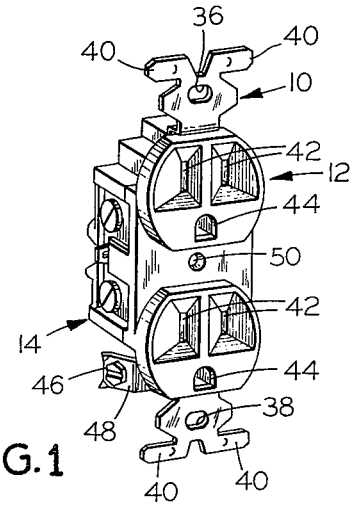
FIG. 1 is a perspective view of a receptacle having an electrical wire terminal contact as provided pursuant to this invention.
Figure 4:
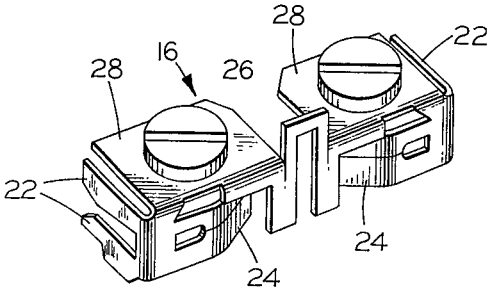
FIG. 4 is a perspective view of a contact strip as employed in the receptacle of FIG. 1.
Figure 2:
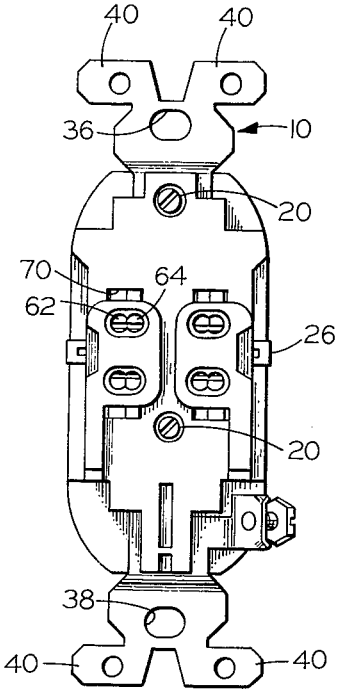
FIG. 2 is a rear elevational view of the receptacle as illustrated in FIG. 1.
Figure 3:
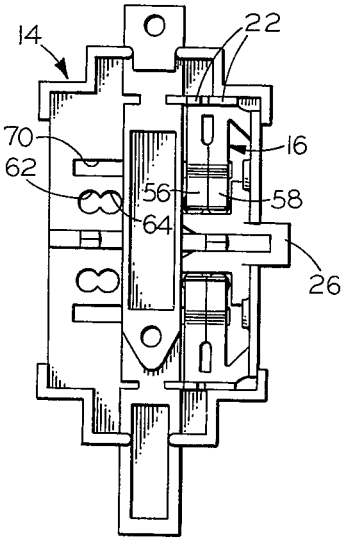
FIG. 3 is an internal view of the rear housing of the receptacle of FIG. 1 with the cover and mounting bracket and one contact strip removed.
Figure 5:
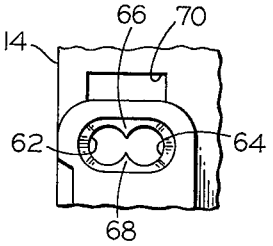
FIG. 5 is a detailed view of the interlocking openings or wire entry ports in the rear of the receptacle housing as viewed from the device exterior.
Figure 6:
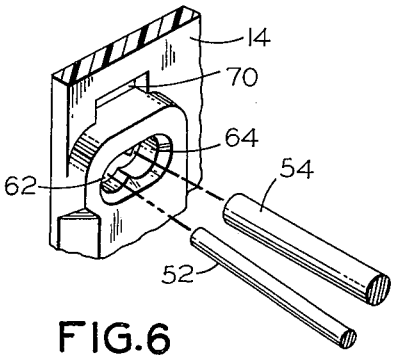
FIG. 6 is a perspective view of the detail as shown on FIG. 5 and illustrating two wires of different size poised for entry into the interlocking wire entry ports.

Referring to the drawing, a conventional receptacle is illustrated in perspective view in FIG. 1. It includes a mounting strap 10, which is mounted between a cover 12 and a base 14. These three elements are held together by means of screws 20 evident in FIG. 2 of the drawing. To assemble the receptacle device, electrical contact numbers 16 are placed in receiving contours, not shown, on the underside of the cover 12. A grounding contact, also not shown, may be mounted in a receiving channel between the electrical contacts 16 and in insulated relation thereto. The mounting strap 10 is superposed over and in electrical contact with the grounding contact and is held in place after assembly of the device due to a pressing of the base 14 against cover 12 under pressure developed by tightening screws 20. This construction is known and conventional and is not part of the invention herein. Much of position adjacent wire locking cams 60 and 62 of contact strip 16 in base 14 as illustrated in FIG. 3.

Figure 7:
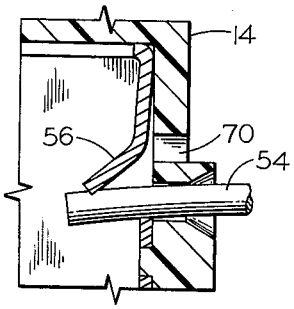
FIG. 7 is a sectional view through the detailed portion of the receptacle as illustrated in FIG. 6 showing a larger wire inserted in place through one of the interlocked wire entry ports and engaging the contact and locking tongue of the contact strip.
Figure 8:
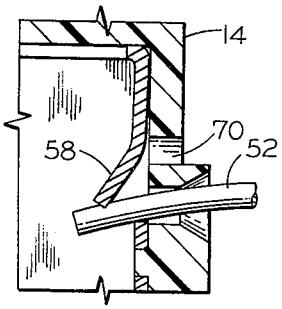
FIG. 8 is a view similar to that of FIG. 7 but illustrating a smaller wire inserted in position in the wire entry port similar to that illustrated in FIG. 7.

In FIG. 7 the contact of the larger diameter copper clad aluminum wire 54 with the cam 56 is illustrated and it is evident that the cam 56 is bent back to a large degree. By contrast, in FIG. 8 the smaller diameter copper core wire 52 is shown in its position within the receptacle base 14 and bearing against the cam 58 in fashion similar to that shown in FIG. 7. Accordingly, where a wire 54 such as that shown in FIG. 7 is deflecting a cam 56 of the pair of contiguous cams of the strip 16 and the second of the contiguous cams 58 is bearing against a smaller diameter wire as a No. 14 gauge wire 52, there would be a separation of contact of the cam 58 from the No. 14 gauge wire 52 if the larger diameter wire did bear against the cam 58 supporting and contacting and gripping the smaller diameter wire 52.

Again an important point here is the retention of the compactness which is made feasible by the contiguous cam arrangement of the U.S. Pat. No. 3,489,985.

Where the two openings were combined into a single large opening, an interference of the two wires was found to occur and contact pressure of the second of a pair of cams was reduced or broken.

However, a distinct advantage of retention of the compactness of the overall wiring device structure, particularly a compactness of the wire terminal electrical contact of this invention was made possible by employing in combination with the contiguous cams, a pair of wire entry ports which each had sufficient size to permit entry of the largest diameter wire, but which were in part separated by an interlocking of the two side-by-side round openings. By this combination, a smaller wire is prevented from escaping from its cam as the device is manipulated and faining the larger wire. Also the larger wire is prevented from bearing on a cam holding a smaller wire to deflect the cam and loosen its grip on the smaller wire.

What is claimed and sought to be protected by letters patent of the United States is:

1. A wire terminal electrical contact for accepting a wide range of wire diameters in the most compact manner possible comprising:

a. an insulating housing, b. a conductive strip of metal having spring properties mounted and supported within said housing, c. said strip having an F configuration of slits formed in the metal strip to form two movable tongues, d. the end portions of said tongues being bent up from the plane of the strip, e. circular openings in the housing aligned with and below the bent-up portions of said tongues, f. said openings each being large enough to admit a wire of the largest diameter in the range and said openings intersecting along their entire extent, g. the area of intersection being smaller than the smallest wire diameter in the range and preventing movement of a smaller diameter wire from one opening to the other.

* * * * *